US009439552B2

(12) United States Patent
Fischer et al.

(10) Patent No.: US 9,439,552 B2
(45) Date of Patent: Sep. 13, 2016

(54) APPARATUS FOR IMPROVING DOOR ROBUSTNESS IN A DISHWASHER

(75) Inventors: Marcus R. Fischer, Stevensville, MI (US); Daniel W. Southworth, South Bend, IN (US); Anthony B. Welsh, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1162 days.

(21) Appl. No.: 13/417,575

(22) Filed: Mar. 12, 2012

(65) Prior Publication Data

US 2013/0234574 A1 Sep. 12, 2013

(51) Int. Cl.
*A47L 15/42* (2006.01)

(52) U.S. Cl.
CPC ..... *A47L 15/4257* (2013.01); *A47L 15/4274* (2013.01)

(58) Field of Classification Search
CPC ..... A47L 15/4257; A47L 15/4293; A47L 15/4259; A47L 15/4265; A47L 15/4409
USPC ..... 134/56 D, 57 D, 18, 200, 58 D, 57 DL; 312/228, 327, 265.6, 311, 213, 265.5, 312/326, 109, 111, 293.3
See application file for complete search history.

(56) References Cited

U.S. PATENT DOCUMENTS

| | | | | |
|---|---|---|---|---|
| 7,014,281 | B2 * | 3/2006 | Wuestefeld et al. | 312/204 |
| 7,594,513 | B2 | 9/2009 | VanderRoest et al. | |
| 8,347,902 | B2 * | 1/2013 | Baldwin | 134/200 |
| 2009/0288692 | A1 * | 11/2009 | Haeberle | A47L 15/4257 134/58 D |
| 2009/0320892 | A1 * | 12/2009 | Poyner | A47L 15/4257 134/56 D |

FOREIGN PATENT DOCUMENTS

| | | | |
|---|---|---|---|
| DE | 4111841 | A1 | 10/1992 |

* cited by examiner

*Primary Examiner* — David Cormier
*Assistant Examiner* — Thomas Bucci

(57) ABSTRACT

A dishwasher for treating dishes according to a cycle of operation includes a tub having an open face, a door selectively moveable to open and close the open face, and comprising spaced interior and exterior panels having peripheral edges that are coupled along at least a portion of the peripheral edges by a peripheral wall to collectively define a door interior, and a controller mounting bracket located within the door interior.

16 Claims, 6 Drawing Sheets

APPARATUS FOR IMPROVING DOOR ROBUSTNESS IN A DISHWASHER

BACKGROUND OF THE INVENTION

Contemporary dishwashers often have a door or other moveable element on which a handle is provided for a user to grasp in moving the moveable element. The handle can be located in the middle of the door, which can lead to excessive flexing in the crown area of the door when a user opens the door with the handle area. The excessive flexing may be perceived as the dishwasher being of a low quality.

SUMMARY OF THE INVENTION

An embodiment of the invention includes a dishwasher having a tub at least partially defining a treating chamber and having an open face, a door selectively moveable to open and close the open face and having a door interior, a controller mounting bracket located within the door interior to extend along one of the panels and a connector coupling the controller mounting bracket to the one of the panels and including an adhesive to bond the connecter to the one of the panels.

DESCRIPTION OF EMBODIMENTS OF THE INVENTION

Figure 1:
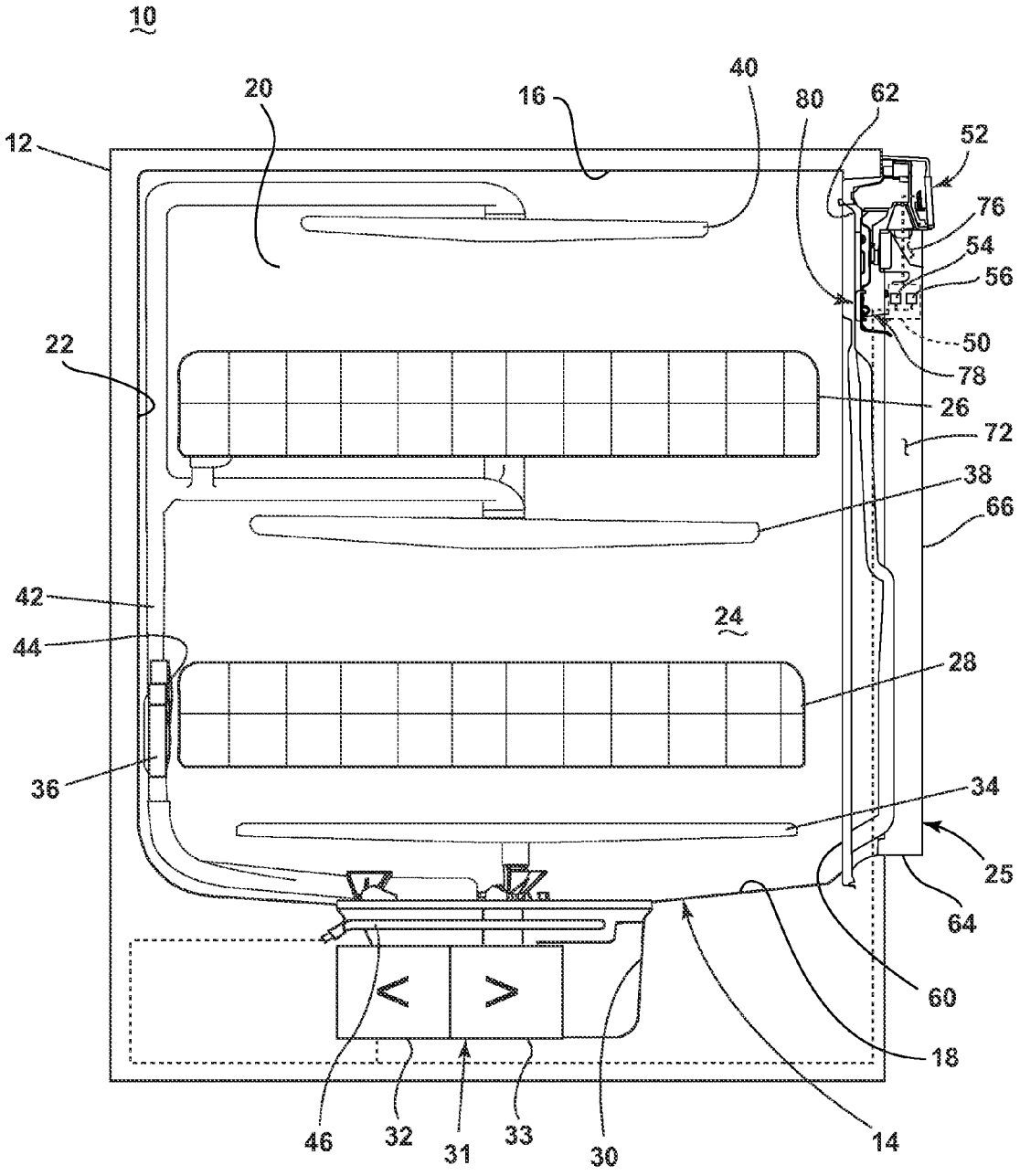
FIG. 1 is a schematic, cross-sectional view of a dishwasher according to a first embodiment of the invention.

In FIG. 1, a first embodiment of the invention is illustrated in the environment of a dishwasher 10 having a chassis 12. The chassis 12 defines an interior and may be a frame with or without panels mounted to the frame. The dishwasher 10 shares many features of a conventional dishwasher, which will not be described in detail herein except as necessary for a complete understanding of the invention. The chassis 12 houses an open-faced wash tub 14 having spaced top and bottom walls 16 and 18, spaced sidewalls 20, and a rear wall 22. The walls 16, 18, 20, and 22 collectively define a treating chamber 24, having an open face, for washing utensils. A door assembly 25 may be movably mounted to the dishwasher 10 for movement between opened and closed positions to selectively open and close the open face of the wash tub 14. Thus, the door assembly provides accessibility to the treating chamber 24 for the loading and unloading of dishes or other washable items.

It should be appreciated that the door assembly 25 may be secured to the lower front edge of the chassis 12 or to the lower front edge of the wash tub 14 via a hinge assembly (not shown) configured to pivot the door assembly 25. When the door assembly 25 is closed, user access to the treating chamber 24 is prevented, whereas user access to the treating chamber 24 is permitted when the door assembly 25 is open.

Dish holders, illustrated in the form of upper and lower dish racks 26, 28, are located within the treating chamber 24 and receive dishes for washing. The upper and lower racks 26, 28 are typically mounted for slidable movement in and out of the treating chamber 24 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 24 and is provided in the form of a first lower spray assembly 34, a second lower spray assembly 36, a rotating mid-level spray arm assembly 38, and/or an upper spray arm assembly 40. Upper spray arm assembly 40, mid-level spray arm assembly 38 and lower spray assembly 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 24. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 24 to the spray system. The recirculation system may include a sump 30 and a pump assembly 31. The sump 30 collects the liquid sprayed in the treating chamber 24 and may be formed by a sloped or recessed portion of a bottom wall of the wash tub 14. The pump assembly 31 may include both a drain pump assembly 32 and a recirculation pump assembly 33. The drain pump assembly 32 may draw liquid from the sump 30 and pump the liquid out of the dishwasher 10 to a household drain line (not shown). The recirculation pump assembly 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 24.

The spray assemblies 34-40 depicted and described herein are for illustrative purposes only, and are not meant to limit the disclosure in any way. It has been contemplated that the spray assemblies 34-40 may be of any structure and configuration. For example, the dishwasher 10 may include other sprayer configurations such as a sprayer assembly movable in a generally vertical plane, a translating wash arm, a discrete nozzle-type sprayer, or an array of wall-mounted nozzle-type sprayers. These may all be individually controllable, or controllable in selected groups, to deliver a spray of wash liquid to selected areas of the treating chamber.

A heating system including a heater 46 may be located within the sump 30 for heating the liquid contained in the sump 30.

A controller 50 may also be included in the dishwasher 10 and may be operably coupled with various components of the dishwasher 10 to implement a cycle of operation. For example, the controller 50 may be coupled with heater 46 for heating the wash liquid during a cycle of operation, the pump assembly 31 and the spray assemblies 34-40 for recirculating the wash liquid during the cycle of operation, and any dispensing systems (not shown for clarity) for dispensing treating chemistry or rinse aids and water to the treating chamber 24 during a cycle of operation. The controller 50 may also be operably coupled with a console or user interface 52 for receiving user-selected inputs and communicating information to the user. The controller 50 may be located within the door assembly 25 as illustrated, or it may alternatively be located somewhere within the chassis 12. The user interface 52 may also be mounted to the door assembly 25 and may include operational controls such as dials, lights, switches, and displays enabling a user to input commands, such as a cycle of operation.

As illustrated schematically in phantom in FIG. 1, the controller 50 may be provided with a memory 54 and a central processing unit (CPU) 56. The memory 54 may be used for storing control software that may be executed by the CPU 56 in completing a cycle of operation using the dishwasher 10 and any additional software. For example, the memory 54 may store one or more pre-programmed cycles of operation that may be selected by a user and completed by the dishwasher 10. The controller 50 may also receive input from one or more sensors (not shown). Non-limiting examples of sensors that may be communicably coupled with the controller 50 include a temperature sensor and turbidity sensor to determine the soil load associated with a selected grouping of dishes, such as the dishes associated with a particular area of the treating chamber.

Figure 2:
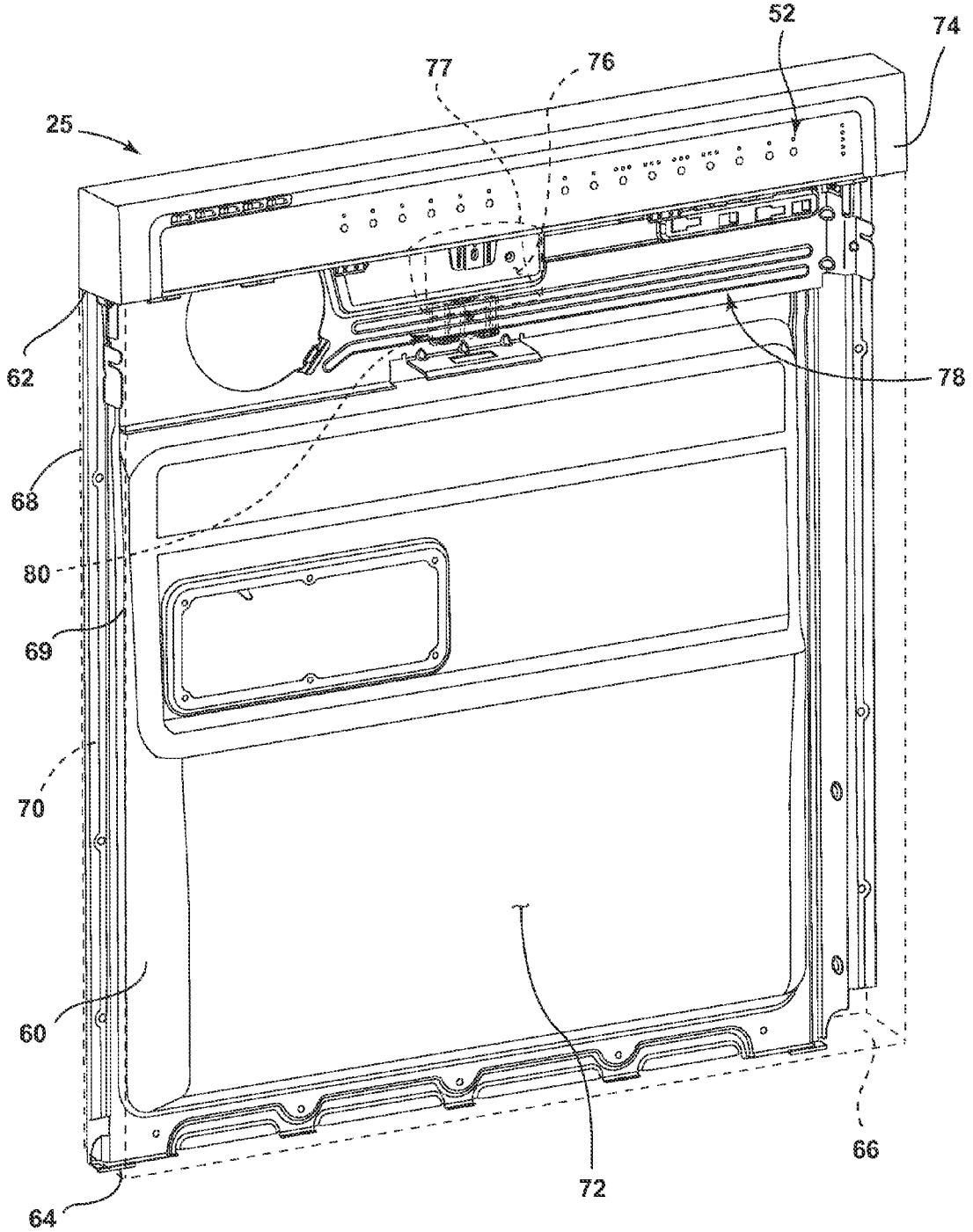
FIG. 2 is a perspective view of a door assembly of the dishwasher shown in FIG. 1 having a portion illustrated in phantom for clarity.

FIG. 2 illustrates in more detail, the door assembly 25 of the dishwasher 10 and additional components thereof. An interior door panel 60 extends downwardly from an upper end 62 of the door assembly 25 to a lower end 64. The interior door panel 60 may be configured to seal the open-face of the wash tub 14. An exterior door panel 66 (illustrated in dashed lines in FIG. 2) extends downwardly from the upper end 62 of the door assembly 25. The interior and exterior door panels 60 and 66 have peripheral edges 68 and 69, respectively, which are coupled along at least a portion of the peripheral edges by a peripheral wall 70 to collectively define the door interior 72.

The user interface 52 may be located in an upper portion 74 of the door assembly 25. A pocket 76 may be located in a portion of the exterior door panel 66 and may extend behind a portion of the user interface 52 into the upper portion 74 of the door assembly 25. A pocket body 77, the upper portion 74 and a portion of the exterior door panel 66 may be configured to collectively form the pocket 76. A latch, handle, or other suitable mechanism (not shown) may be located within the pocket 76 and may be operated by a user to move the door assembly 25 from the closed position to the opened position. While the pocket 76 has been illustrated as extending behind the user interface 52 it will be understood that the pocket 76 need not extend behind the user interface.

Figure 3:
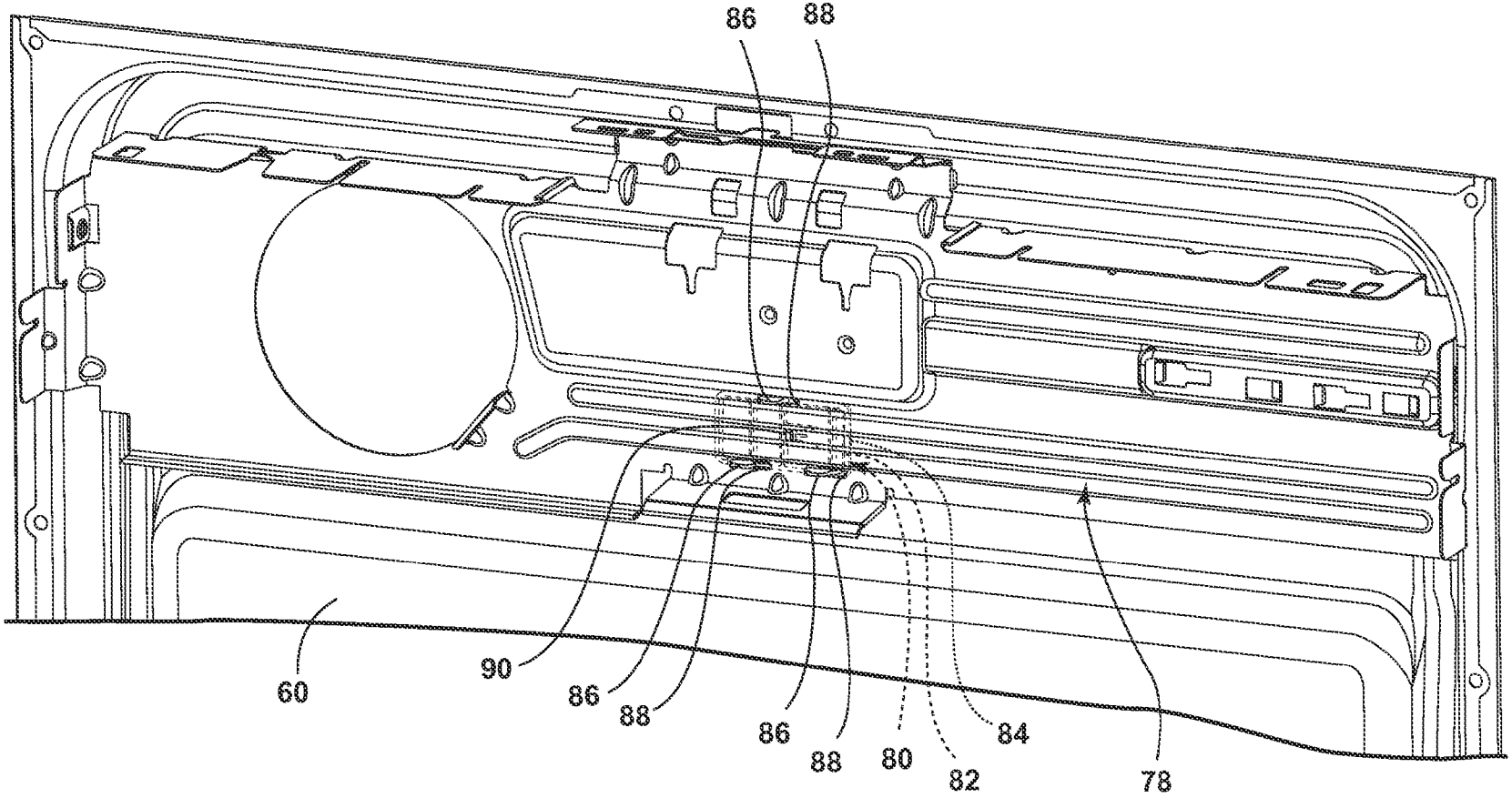
FIG. 3 is a perspective view of an upper portion of the door assembly shown in FIG. 2.
Figure 4:
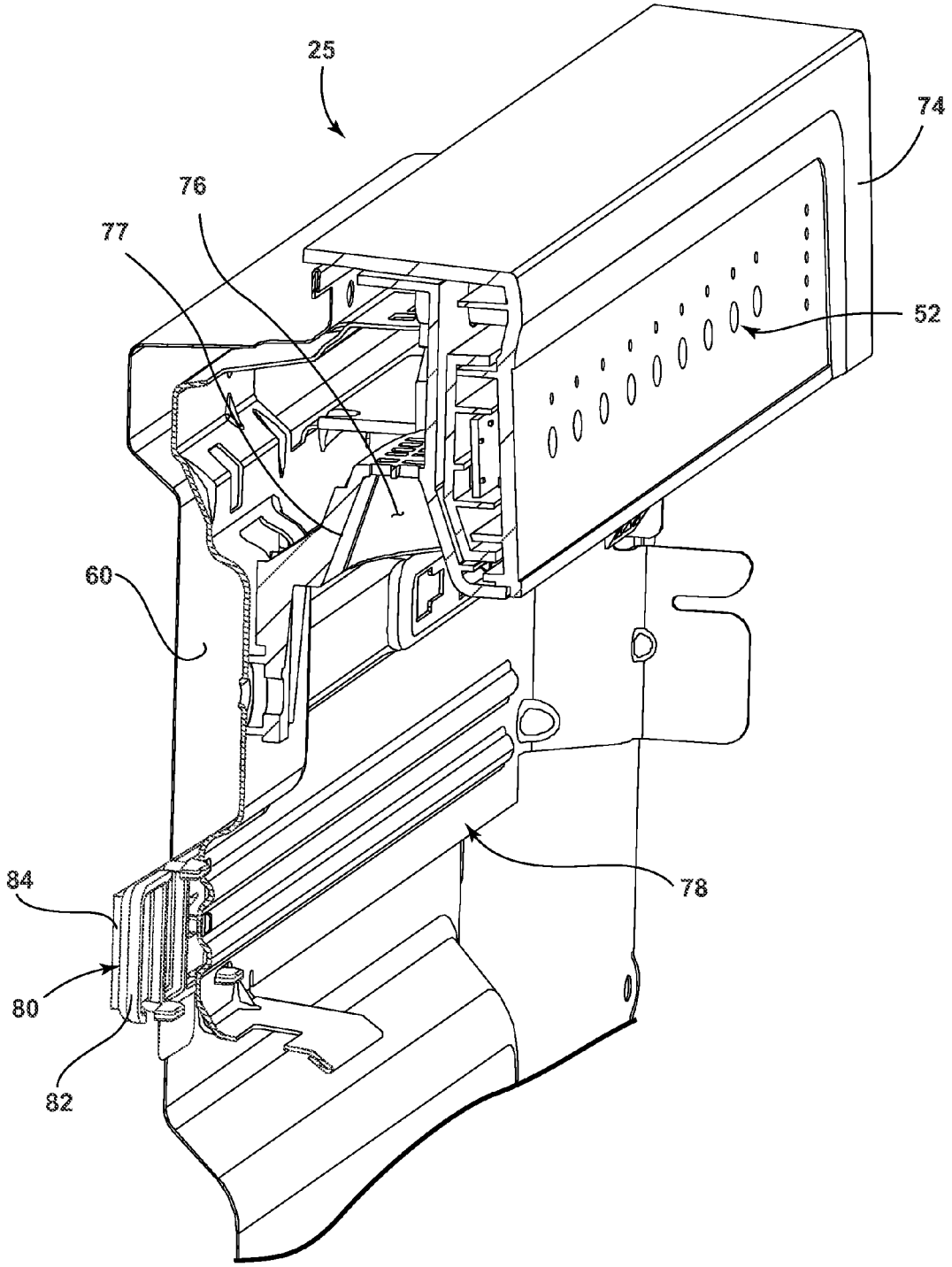
FIG. 4 is a cross-sectional view of a portion of the door assembly shown in FIG. 2.

A controller mounting bracket 78 may be located within the door interior 72 and may have the controller 50 mounted to it. The controller mounting bracket 78 may more easily be seen with reference to FIG. 3. The controller mounting bracket 78 may be mounted to the peripheral wall 70. More specifically, each of the distal ends of the controller mounting bracket 78 may be mounted to one of the opposing side portions of the peripheral wall 70. The controller mounting bracket 78 may be mounted to the peripheral wall 70 using any suitable mechanical mean including a screw (not shown). The controller mounting bracket 78 is illustrated as extending along the interior door panel 60 but may alternatively extend along the exterior door panel 66. Regardless of which door panel the controller mounting bracket 78 extends along, the controller mounting bracket 78 may be spaced slightly therefrom to avoid rattling against the door panel during operation of the dishwasher 10. In prior art dishwashers this spacing also allowed the door to flex when then handle was pulled. As shown more clearly in FIG. 4, a portion of the controller mounting bracket 78 may be adjacent a portion of the pocket body 77. Such adjacent portions of the controller mounting bracket 78 and the pocket body 77 may be mounted to each other or otherwise operably coupled to each other.

A connector 80 may be used to couple the controller mounting bracket 78 to one of the interior and exterior door panels 60 or 66. By way of example, a connector 80 has been illustrated as including a spacer 82, which may couple the controller mounting bracket 78 to the interior door panel 60. The spacer 82 may be formed from any suitable material including a plastic or a thermoplastic material such as ABS. The connector 80 may also include an adhesive 84 coupled to the spacer 82. The adhesive 84 may be an adhesive layer applied to the spacer 82. The adhesive 84 may alternatively be an adhesive layer or an acrylic adhesive on acrylic foam. Regardless of the form of the adhesive 84, it is contemplated that the adhesive 84 may include a release liner and a pull tab (not shown) to remove the release liner. When the release liner is removed, the adhesive 84 may be used to bond the space 82 to the interior door panel 60. In such a described example the adhesive 84 may be any suitable adhesive capable of bonding to both thermoplastic and stainless steel, which the interior door panel 60 may be formed of.

Figure 5:
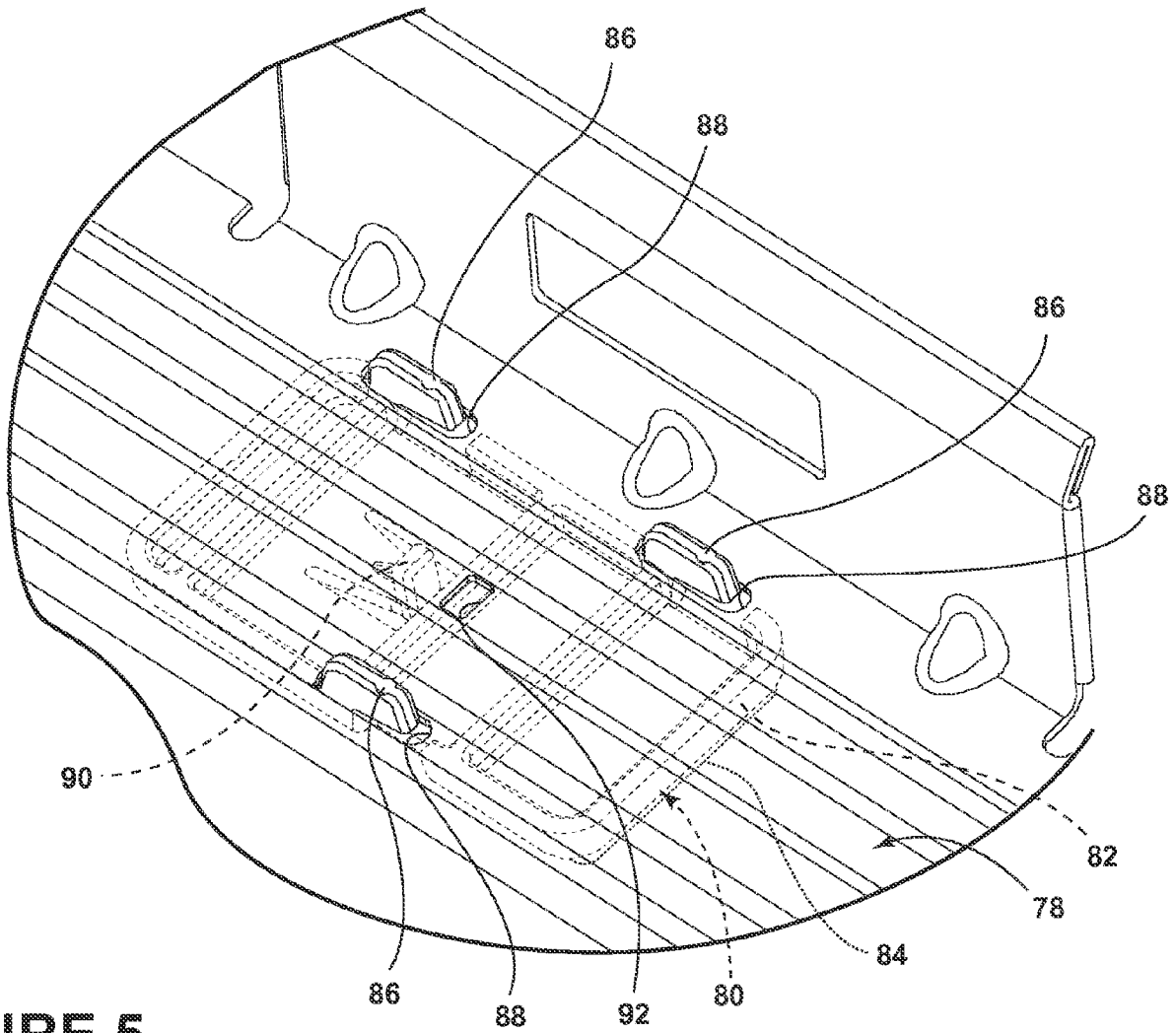
FIG. 5 is a perspective view of an unassembled spacer and a portion of a controller mounting bracket, which may be assembled and mounted in the door assembly as shown in FIG. 2.
Figure 6:
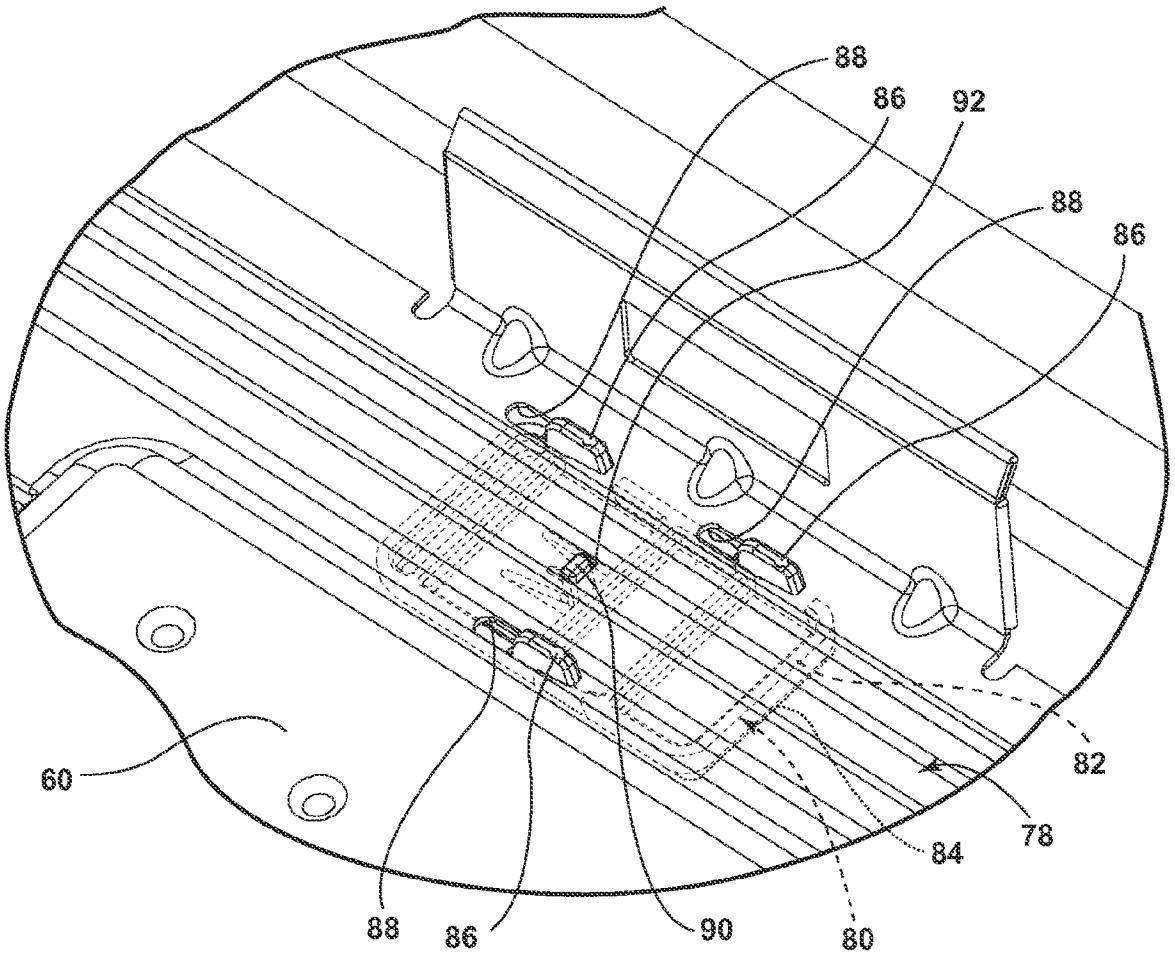
FIG. 6 is a perspective view of the spacer and the controller mounting bracket assembled and attached to an interior door panel of the door assembly of FIG. 2.

As illustrated, the spacer 82 may be mechanically coupled to the controller mounting bracket 78. More specifically, the spacer 82 has been illustrated as including several tabs 86 and a snap 90 and the controller mounting bracket 78 has been illustrated as including several openings 88, which may align with the tabs 86 and another opening 92, which may align with the snap 90. FIGS. 5 and 6 illustrate how the spacer 82 may be mounted to the controller mounting bracket 78. More specifically, FIG. 5 illustrates that at least a portion of each of the tabs 86 may be inserted into and located in each of the openings 88. The spacer 82 may then be moved with respect to the controller mounting bracket 78 such that the tabs 86 move in the openings 88 until they reach an end of the openings 88 and the tabs 86 overlap a portion of the controller mounting bracket 78, as shown in FIG. 6. The tabs 86, openings 88, and controller mounting bracket 78 may be sized such that when the spacer 82 is moved to this overlapping position with respect to the controller mounting bracket 78, the controller mounting bracket 78 and the spacer 82 may have an interference fit and the spacer 82 may be securely mounted to the controller mounting bracket 78. As the tabs 86 are slid within the openings 88, the snap 90 may be pushed through the opening 92 in the controller mounting bracket 78 to further mount the spacer 82 to the controller mounting bracket 78. While multiple tabs and corresponding openings have been shown, it will be understood that any number of tabs and corresponding openings may be used to mount the spacer to the controller mounting bracket. Further, any number of snaps may be included, including that no snaps may be included and only the interference fit may be utilized to mount the spacer to the controller mounting bracket. Further, any other suitable mechanism may be used to mount the spacer 82 to the controller mounting bracket 78 including that an adhesive may be used to mount the spacer 82 to the controller mounting bracket 78.

After the spacer 82 is mounted to the controller mounting bracket 78, any liner on the adhesive 84 may then be removed and the adhesive 84 may mount the spacer 82 to the interior door panel 60. It is contemplated that the controller mounting bracket 78 may be mounted to the interior door panel 60 only by the connector 80. The connector 80 may make a physical connection between the pocket handle area of the door assembly 25 and exterior door panel 66 or the interior door panel 60 to improve robustness of the door assembly 25 and minimize flexing. While the above described embodiments have thus far been described as using the connector 80 to couple the controller mounting bracket 78 to the interior door panel 60 it will be understood that the connector may alternatively couple the controller mounting bracket 78 to the exterior door panel 66.

The above described embodiments provide a variety of benefits including that they allow forces applied to the pocket area of the door assembly to be distributed throughout the entire door assembly, which decreases the amount of deflection felt by a user, when a user moves the door assembly between open and closed positions. This may increase the perceived strength of the door assembly. Further, the above described embodiments allow for the separate spacer with adhesive to be applied to only the models that require it to improve door robustness.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, the spacer portion of the connector may be integrally formed with the controller mounting bracket and an adhesive layer may be applied to the integrally formed spacer, which may then be used bond the connecter to either the interior panel or the exterior panel. By way of another example, the dishwasher may not include the controller mounting bracket and the connector may instead be operably coupled to one of a console mounted to one of the panels and/or a pocket handle area located in a portion of one of the panels. The connector may be coupled through adhesive or other mechanical means to the console and/or the pocket handle area and may include an adhesive to bond the connecter to the other one of the panels.

What is claimed is:

1. A dishwasher for treating dishes according to a cycle of operation, comprising:

a tub at least partially defining a treating chamber and having an open face;

a door selectively moveable to open and close the open face, and comprising spaced interior and exterior panels having peripheral edges that are coupled along at least a portion of the peripheral edges by a peripheral wall to collectively define a door interior;

a controller mounting bracket mounted to the peripheral wall and located within the door interior to extend along one of the panels;

a controller mounted to the controller mounting bracket; and a connector coupling the controller mounting bracket to the one of the panels and including an adhesive to bond the connecter to the one of the panels.

2. The dishwasher of claim 1 wherein the connector further includes a spacer located between the controller mounting bracket and the one of the panels, with the adhesive applied to the spacer.

3. The dishwasher of claim 2 wherein the spacer and the controller mounting bracket are integrally formed.

4. The dishwasher of claim 2 wherein the spacer is mechanically coupled to the controller mounting bracket.

5. The dishwasher of claim 4 wherein the controller mounting bracket includes at least one opening and the spacer includes at least one tab and at least a portion of the at least one tab may be located in the at least one opening to mount the spacer to the controller mounting bracket.

6. The dishwasher of claim 5 wherein the spacer further comprises a snap that may extend through another opening in the controller mounting bracket to mount the spacer to the bracket.

7. The dishwasher of claim 5 wherein the controller mounting bracket and the spacer have an interference fit when the spacer is mounted to the controller mounting bracket.

8. The dishwasher of claim 7 wherein the adhesive mounts the spacer to the interior panel.

9. The dishwasher of claim 8 wherein the spacer is made of plastic and the door is made of stainless steel.

10. The dishwasher of claim 1 wherein the peripheral wall comprises opposing side portions and the controller mounting bracket is mounted to each of the opposing side portions.

11. The dishwasher of claim 10 wherein the one of the panels is the exterior panel.

12. The dishwasher of claim 1 wherein the controller mounting bracket is mounted to the one of the panels only by the connector.

13. A dishwasher for treating dishes according to a cycle of operation, comprising:

a tub at least partially defining a treating chamber and having an open face;

a door selectively moveable to open and close the open face, and comprising spaced interior and exterior panels having peripheral edges that are coupled along at least a portion of the peripheral edges by a peripheral wall to collectively define a door interior and having a pocket handle area located in a portion of one of the panels;

a controller mounting bracket mounted to the peripheral wall and located within the door interior to extend along one of the panels and adjacent a portion of the pocket handle area;

a controller mounted to the controller mounting bracket; and a connector with adhesive mounted thereto, structurally coupling the pocket handle area to the controller mounting bracket where the adhesive bonds the connecter to the controller mounting bracket.

14. The dishwasher of claim 1 wherein the controller mounting bracket is a brace that spans only a fraction of a height of the door.

15. The dishwasher of claim 1 wherein the controller mounting bracket is mounted to the interior panel only by the connector.

16. The dishwasher of claim 13 wherein the controller mounting bracket is sized such that it spans only a fraction of a height of the door.

* * * * *